US006923670B2

(12) United States Patent
Holmes et al.

(10) Patent No.: US 6,923,670 B2
(45) Date of Patent: Aug. 2, 2005

(54) PLATE LOCKING SYSTEM FOR MATED ELECTRICAL CONNECTORS AND METHODS THEREOF

(75) Inventors: Liam Holmes, County Cork (IE); Martin O'Donnell, County Cork (IE)

(73) Assignee: Anderson Power Products, Sterling, MA (US)

( * ) Notice: Subject to any disclaimer, the term of this patent is extended or adjusted under 35 U.S.C. 154(b) by 0 days.

(21) Appl. No.: 10/644,102

(22) Filed: Aug. 19, 2003

(65) Prior Publication Data

US 2004/0175981 A1 Sep. 9, 2004

Related U.S. Application Data

(60) Provisional application No. 60/404,566, filed on Aug. 19, 2002.

(51) Int. Cl.[7] ..... H01R 13/62
(52) U.S. Cl. ..... 439/368; 439/351; 439/352
(58) Field of Search ..... 439/351, 352, 439/358, 361, 368, 369, 370, 372, 160

(56) References Cited

U.S. PATENT DOCUMENTS 3,824,522 A * 7/1974 Bertrams et al. ..... 439/372
4,165,142 A * 8/1979 Grabau ..... 439/370
4,198,024 A * 4/1980 Cavanna ..... 439/358
4,319,733 A * 3/1982 Hanna et al. ..... 439/370
4,350,403 A * 9/1982 Seytre et al. ..... 439/370
5,364,287 A * 11/1994 Weber ..... 439/358
5,472,354 A 12/1995 Chen et al.
5,494,451 A * 2/1996 Bowers ..... 439/358
5,660,557 A * 8/1997 Lemke et al. ..... 439/358
5,879,194 A * 3/1999 Thenaisie et al. ..... 439/358
6,089,898 A * 7/2000 Lincoln et al. ..... 439/357
6,139,366 A * 10/2000 van Woensel ..... 439/358
6,371,788 B1 * 4/2002 Bowling et al. ..... 439/358
6,592,380 B2 7/2003 Miyazawa et al.

FOREIGN PATENT DOCUMENTS

JP 1-258373 * 10/1989 ..... 439/372

* cited by examiner

*Primary Examiner*—Tho D. Ta
(74) *Attorney, Agent, or Firm*—Nixon Peabody LLP

(57) ABSTRACT

An electrical connection system includes a first electrical connector, a second electrical connector, and a locking plate. The second electrical connector having one of a projecting boss and a boss opening. The locking plate is connected to the first electrical connector and has the other one of the projecting boss and the boss opening. The engagement of the boss with the boss opening locks the second electrical connector to the first electrical connector.

19 Claims, 5 Drawing Sheets

PLATE LOCKING SYSTEM FOR MATED ELECTRICAL CONNECTORS AND METHODS THEREOF

This application claims the benefit of U.S. Provisional Patent Application Ser. No. 60/404,566 filed Aug. 19, 2002, which is herein incorporated by reference in its entirety.

FIELD OF THE INVENTION

This invention relates generally to electrical connectors and, more particularly, a plate locking system for mated electrical connectors.

BACKGROUND OF THE INVENTION

A variety of different types of electrical connectors are used to couple electrical leads together. Unfortunately, one of the problems with existing electrical connectors, such as Euro DIN connectors, is that with vibration the electrical connectors can easily disconnect.

SUMMARY OF THE INVENTION

An electrical connection system in accordance with embodiments of the present invention includes a first electrical connector, a second electrical connector, and a plate. The first electrical connector has a first housing and the second electrical connector has a second housing with one of a projection and a projection opening along one surface. The plate is connected to the first housing and has the other one of the projection and the projection opening. When the first housing is connected to the second housing to couple the first electrical connector to the second electrical connector, the projection is detachably engaged with the projection opening to detachably lock the first electrical connector to the second electrical connector.

A method of making an electrical connection system in accordance with embodiments of the present invention includes providing a first electrical connector with a first housing and providing a second electrical connector with a second housing. The second housing has one of a projection and a projection opening along one surface. The plate is connected to the first housing and has the other one of the projection and the projection opening. When the first housing is connected to the second housing to couple the first electrical connector to the second electrical connector, the projection is detachably engaged with the projection opening to detachably lock the first electrical connector to the second electrical connector.

A method for securing electrical connectors in accordance with embodiments of the present invention includes coupling a first electrical connector which is connected to a plate to a second electrical connector. At least one projection on one of the second electrical connector and a plate is aligned with a projection opening in the other one of the second electrical connector and the plate. The second electrical connector is locked to the first electrical connector with the engagement of the projection with the projection opening.

The present invention provides a complete and integrated locking system for electrical connectors which prevents the electrical connectors from coming apart during use. Additionally, the present invention provides a mechanism which is simple and easy for an operator to use to quickly unlock electrical connectors.

DETAILED DESCRIPTION

An electrical connection system 10 in accordance with an embodiment of the present invention is illustrated in FIGS. 1–5E. The electrical connection system 10 includes a first electrical connector 12, a second electrical connector 14, and a locking plate 16, although the electrical connection system 10 may comprise other types, numbers, and combinations of components. The present invention provides a number of advantages including providing a complete and integrated locking system for electrical connectors with a quick release system.

Figure 1:
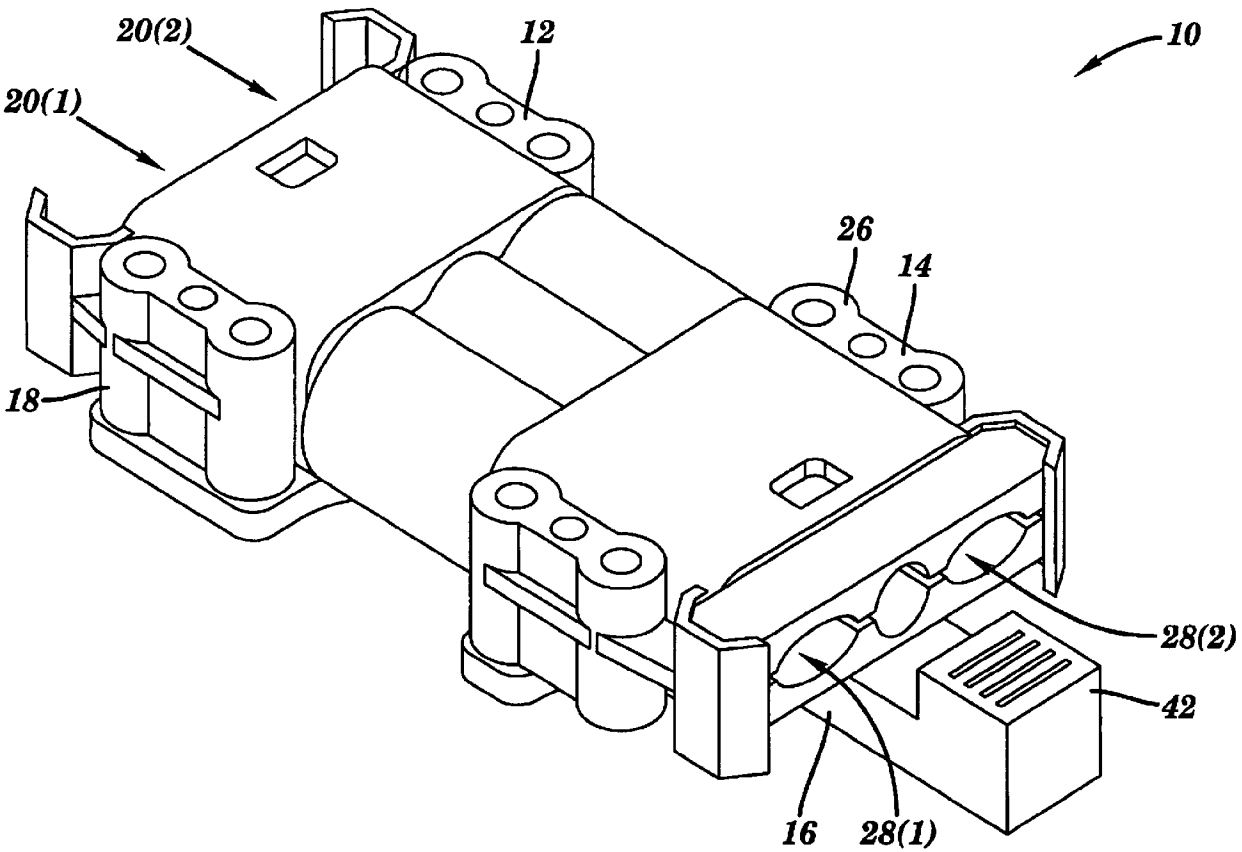
FIG. 1 is a perspective view of an electrical connection system in a locked position in accordance with embodiments of the present invention.
Figure 2:
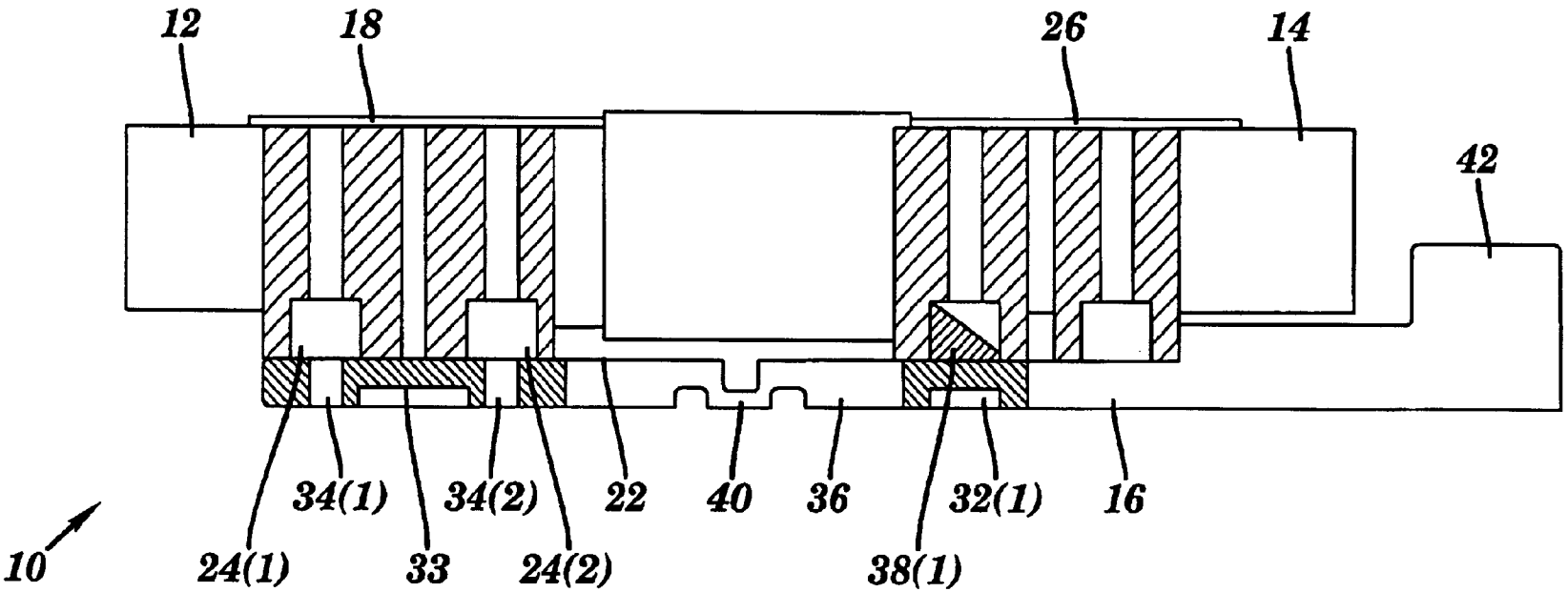
FIG. 2 is a cross-sectional view of the electrical connection system in the locked position shown in FIG. 1.
Figure 3:
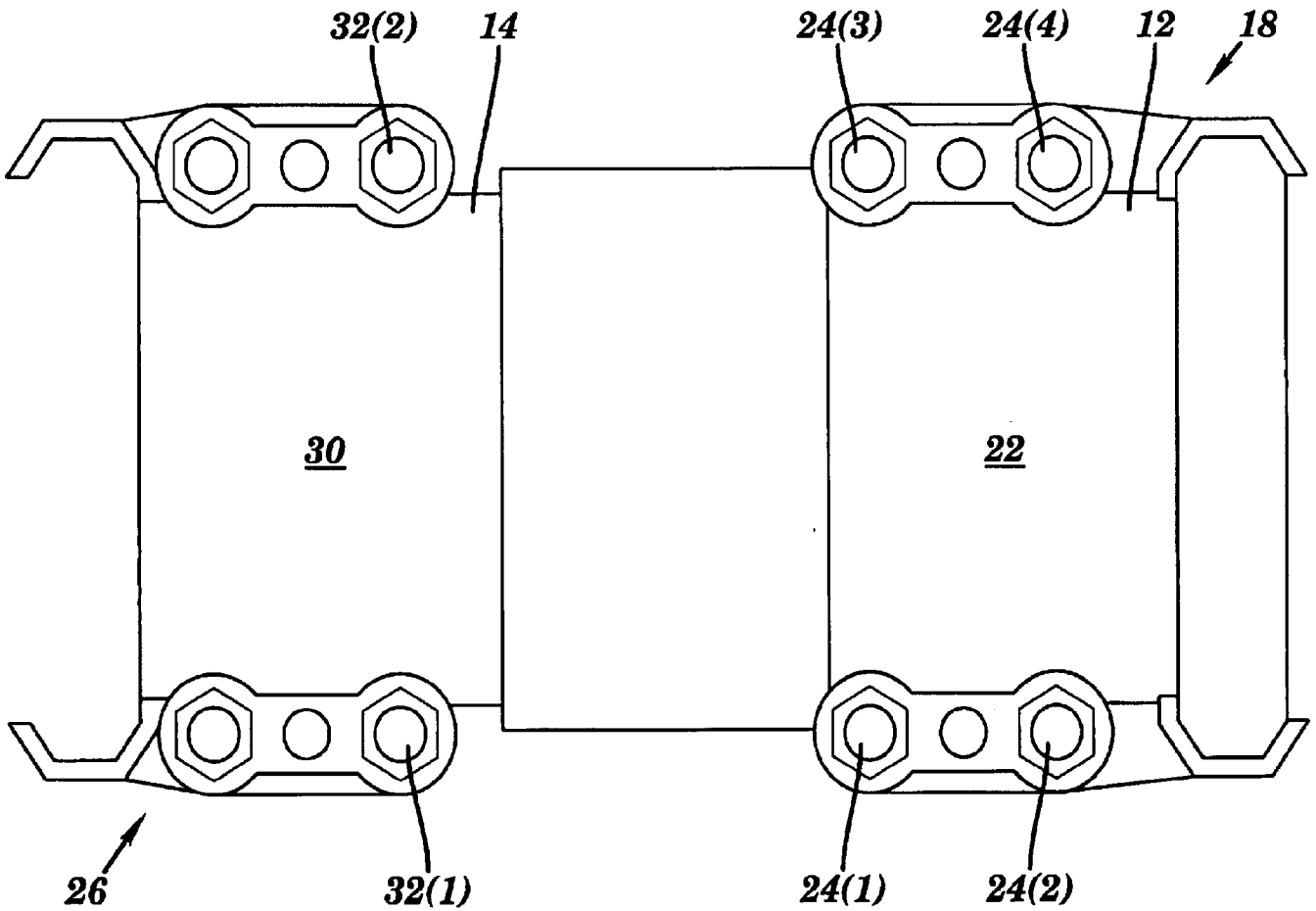
FIG. 3 is a bottom view of electrical connectors for the electrical connection system coupled together with a locking plate removed.

Referring to FIGS. 1–3, the first electrical connector 12 include a first housing 18 with first passages 20(1) and 20(2) to receive and secure a first pair of electrical leads, although the number and shapes of first passages 20(1) and 20(2) to receive first electrical leads can vary and the first electrical leads can be coupled to the first housing 18 in other manners. Since the manner in which electrical leads are secured and coupled to an electrical connector are well know, it will not be described here. The bottom surface 22 of the first housing 18 includes openings 24(1)–24(4) which are used to connect the first electrical connector 12 to the locking plate 16 with bolts, although other number of openings and other types of securing devices can be used to secure the first electrical connector 12 to the locking plate 16.

The second electrical connector 14 includes a second housing 26 with second passages 28(1) and 28(2) to receive and secure a second pair of electrical leads, although the number and shape of second passages 28(1) and 28(2) to receive second electrical leads can vary and the second electrical leads can be coupled to the second housing 26 in other manners. Since the manner in which electrical leads are secured and coupled to an electrical connector are well know, it will not be described here. The bottom surface 30 of the second housing 26 includes boss openings 32(1) and 32(2) which are used to detachably lock the second electrical connector 14 to the first electrical connector 12, although the bottom surface 30 of the second electrical connector 14 could have other configurations, such as other numbers of opening or one or more bosses or other projections which engage one or more openings on the locking plate 16.

The first electrical connector 12 is a female connector and the second electrical connector 14 is a male electrical connector which can be mated together to form an electrical connection, although other types of first and second electrical connectors 12 and 14 can be used, such as genderless electrical connectors or other male and female connector configurations. Since the manner in which electrical connectors are coupled together to form an electrical connection and to couple leads coupled to each of the electrical connectors together is well know, it will not be described here.

Referring to FIGS. 1, 2, and 4–5E, the locking plate 16 includes a first section 33 with holes 34(1)–34(4), although the first section 33 can have other numbers of holes. The holes 34(1)–34(4) are spaced apart substantially the same distance apart as the openings 24(1)–24(4) on the bottom surface 22 of the first housing 18. When the locking plate 16 is positioned to be secured to the bottom surface 22 of the first housing 18, the holes 34(1)–34(4) are substantially aligned with the openings 24(1)–24(4). Bolts extend into the holes 34(1)–34(4) in the first section 33 of the locking plate 16 and the openings 24(1)–24(4) in the first housing 18 to secure the first section 33 of the locking plate 16 to the first housing 18, although other types of securing devices can be used to connect to secure the first section 33 of the locking plate 16 to the first housing 18.

The locking plate 16 includes a second section 36 with a pair of bosses 38(1) and 38(2) projecting from the second section 36 on substantially opposing sides, although the locking plate 16 can have other types and numbers of projections in other locations. The bosses 38(1) and 38(2) are spaced apart substantially the same distance apart as the openings 32(1)–32(2) so that when the second electrical connector 14 is connected to the first electrical connector 12 the bosses 38(1) and 38(2) for the locking plate 16 are substantially aligned with the openings 32(1) and 32(2). The detachable engagement of each the bosses 38(1) and 38(2) in one of the boss openings 32(1) and 32(2) detachably locks the second electrical connector 14 to the first electrical connector 12. Although the bosses 38(1) and 38(2) are shown on the locking plate 16 and the boss openings 32(1) and 32(2) are on the second electrical connector 14, other configurations can be used, such as having one or more of the bosses on the second electrical connector 14 and one or more of the boss openings on the locking plate 16. Additionally, although bosses 38(1) and 38(2) with corresponding boss openings 32(1) and 32(2) are shown as the locking mechanism, other types of detachable locking mechanisms can be used.

The locking plate 16 also includes a spring 40 which is located between the first section 33 and the second section 36, although other types of biasing or pivoting mechanisms could be used in other locations on the locking plate 16. Since the first section 33 is secured to the first housing 18, with the spring 40 the second section 36 can pivot with respect to the first section 33. The spring 40 is formed in the locking plate 16 to have a normal or neutral position where the bosses 38(1) and 38(2) on the second section 36 are seated in the boss openings 32(1) and 32(2). The second section 36 can be pivoted about the spring 40 to a release position where the bosses 38(1) and 38(2) are withdrawn from the boss openings 32(1) and 32(2) to unlock the second electrical connector 14 from the first electrical connector 12 and the second section 36 is being biased back to the neutral position by the spring 40. The first and second sections 33 and 36 and the spring 40, could be configured to have other.

A lock release button 42 is integrally formed on the second section 36 opposite from the spring 40, although other types release mechanisms in other locations could be used. When the lock release button 42 is pressed in a general direction away from the second section 36, the second section 36 is moved from the neutral position to the release position about the spring 40.

Figure 4:
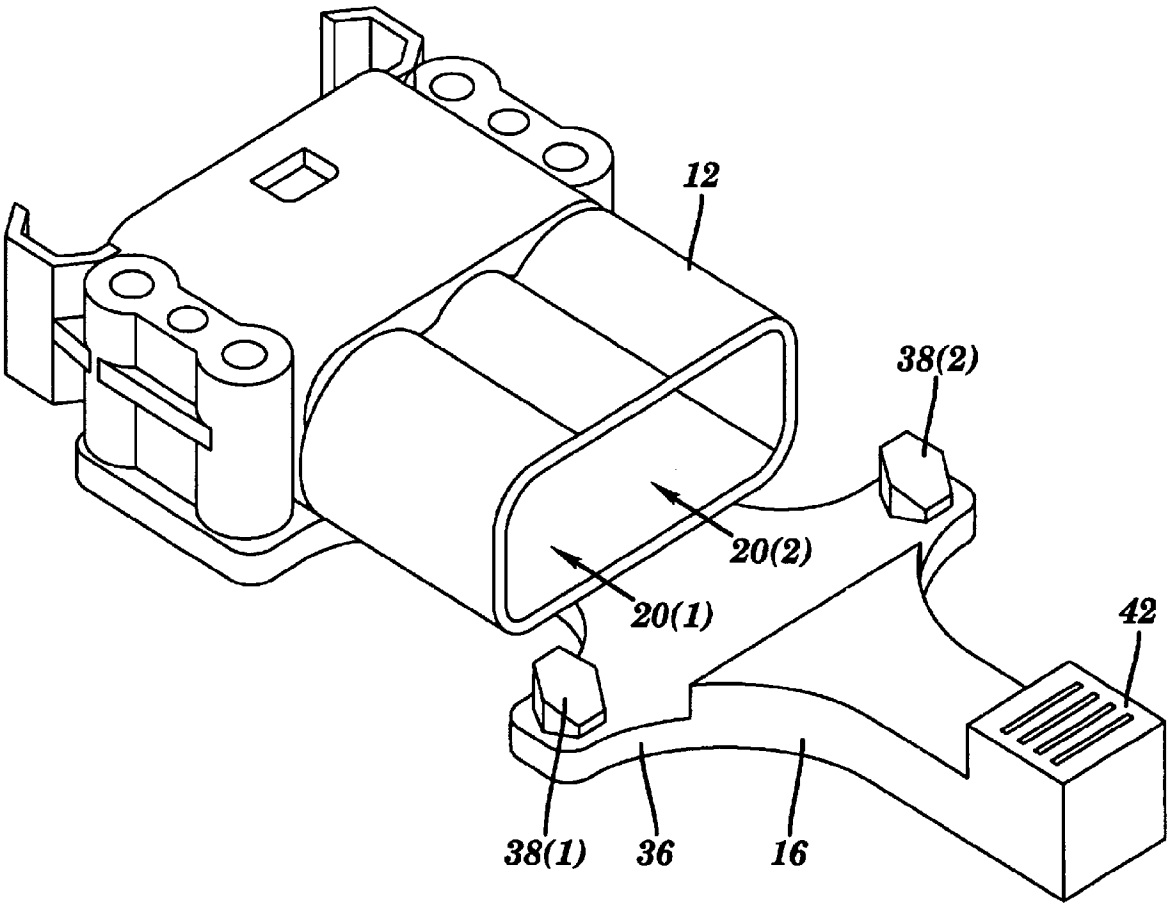
FIG. 4 is a perspective view of the electrical connection system with one of the electrical connectors disconnected.
Figure 5D:
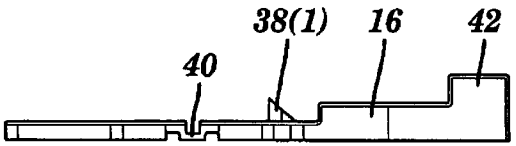
FIG. 5D is a view of one side of the locking plate.
Figure 5E:
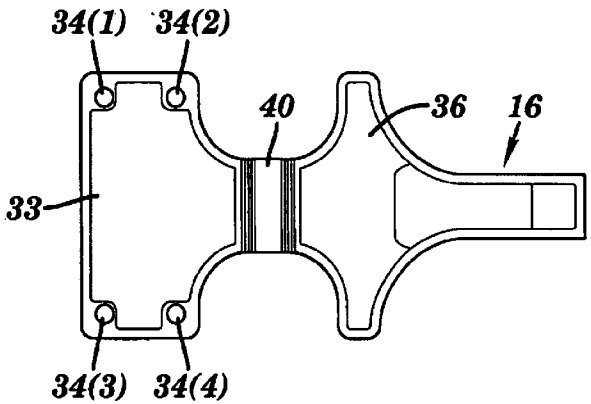
FIG. 5E is bottom view of the locking plate.
Figure 5C:
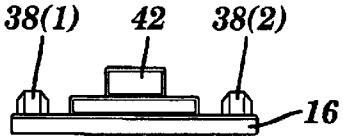
FIG. 5C is a view of another end the locking plate.
Figure 5B:
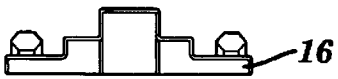
FIG. 5B is a view of one end the locking plate.
Figure 5A:
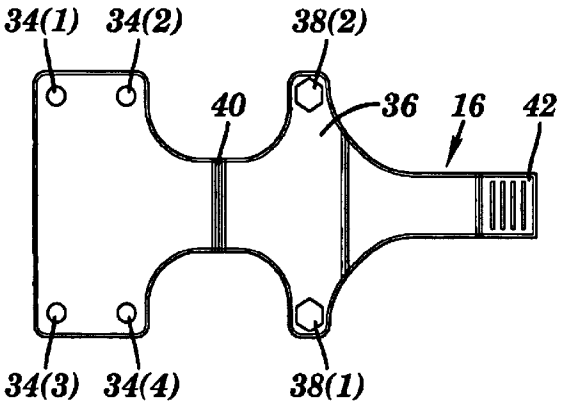
FIG. 5A is a top view of the locking plate.

The operation of the electrical connection system 10 will be described with reference to FIGS. 1–5E. The first section 33 of locking plate 16 is secured to the first electrical connector 12 with bolts through the openings 24(1)–24(4) and 34(1)–34(4), although other manners for securing the first section 33 of locking plate 16 to the first electrical connector 12 can be used. The second section 36 of the locking plate 16 extends out past the female mating end of the first electrical connector 12 as shown in FIG. 4.

Next, the male housing 26 of the second electrical connector 14 is mated with the female housing 18 of the first electrical connector 12 to electrically couple the first and second electrical connectors 12 and 14 together. This also couples the electrical leads in passages 20(1) and 20(2) to the electrical leads in passages 28(1) and 28(2) together.

To permit the first and second housings 18 and 26 of the first and second electrical connectors 12 and 14 to mate, the lock release button 42 is pushed away from the general desired location of the second electrical connector 14. When the release button 42 is pushed, the second section 36 is moved from the neutral position to the release position.

Once the first and second electrical connectors 12 and 14 are coupled together, the release button 42 is release and the spring 40 biases the second section 36 back to the neutral position. When the second section 36 returns to the neutral position, the bosses 38(1) and 38(2) mate with the boss openings 32(1) and 32(2) on the surface 30 of the second electrical connector 14. The engagement of the bosses 38(1) and 38(2) in the boss openings 32(1) and 32(2) detachably locks the first and second electrical connectors 12 and 14 together.

To break the connection between the first and second electrical connectors 12 and 14, the release button 42 is pressed in a general direction away from the second section 36. The second section 36 is moved from the neutral position to the release position about the spring 40. This movement breaks the engagement of the bosses 38(1) and 38(2) from the boss openings 32(1) and 32(2) unlocks the first and second electrical connectors 12 and 14. The second electrical connector 14 is then disconnected from the first electrical connector 12 to break the electrical connection.

Accordingly, as described above the present invention provides a complete and integrated locking system for electrical connectors which prevents the electrical connectors from coming apart during use. Additionally, the present invention provides a mechanism which is simple and easy for an operator to use to quickly unlock electrical connectors.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefor, is not intended to limit the claimed processes to any order except as may be specified in the claims. Accordingly, the invention is limited only by the following claims and equivalents thereto.

What is claimed is:

1. An electrical connection system, the system comprising:

a first electrical connector with a first housing;

a second electrical connector with a second housing, the second housing having one of a projection and a projection opening along one surface;

a plate connected to the first housing, the plate having the other one of the projection and the projection opening, when the first housing is connected to the second housing to couple the first electrical connector to the second electrical connector the projection is detachably engaged with the projection opening to detachably lock the first electrical connector to the second electrical connector, wherein an outer periphery of the projection is substantially the same size as an inner periphery of the projection opening.

2. The system as set forth in claim 1 wherein the second electrical connector and the plate have two or more of the projection and the projection opening used to lock the second electrical connector to the first electrical connector.

3. The system as set forth in claim 1 wherein the plate has a neutral position where the projection is seated in the projection opening and a release position where the projection is withdrawn from the projection opening to unlock the second electrical connector from the first electrical connector.

4. The system as set forth in claim 1 wherein the first electrical connector is one of a male electrical connector and a female electrical connector and the second electrical connector is the other one of the male electrical connector and the female electrical connector.

5. The system as set forth in claim 1 wherein the outer periphery of the projection and the inner periphery of the projection opening have the substantially the same shape.

6. The system as set forth in claim 1 wherein the plate comprises:

a first section connected to the first electrical connector;

a second section having the other one of the projection and the projection opening; and a biasing element connected between the first and second sections, the biasing element is spaced a first distance away from and is not adjacent to the other one of the projection and the projection opening on the plate.

7. The system as set forth in claim 6 wherein the second section has a neutral position where the projection is seated in the projection opening and a release position where the projection is withdrawn from the projection opening to unlock the second electrical connector from the first electrical connector.

8. A method of making an electrical connection system, the method comprising:

providing a first electrical connector with a first housing;

providing a second electrical connector with a second housing, the second housing having one of a projection and a projection opening along one surface;

connecting a plate to the first housing, the plate having the other one of the projection and the projection opening, when the first housing is connected to the second housing to couple the first electrical connector to the second electrical connector the projection is detachably engaged with the projection opening to detachably lock the first electrical connector to the second electrical connector, wherein an outer periphery of the projection is substantially the same size as an inner periphery of the projection opening.

9. The method as set forth in claim 8 wherein the second electrical connector and the plate have two or more of the projection and the projection opening used to lock the second electrical connector to the first electrical connector.

10. The method as set forth in claim 8 wherein the plate has a neutral position where the projection is seated in the projection opening and a release position where the projection is withdrawn from the projection opening to unlock the second electrical connector from the first electrical connector.

11. The method as set forth in claim 8 wherein the outer periphery of the projection and the inner periphery of the projection opening have the substantially the same shape.

12. The method as set forth in claim 8 wherein the first electrical connector is one of a male electrical connector and a female electrical connector and the second electrical connector is the other one of the male electrical connector and the female electrical connector.

13. The method as set forth in claim 8 wherein the plate comprises:

a first section connected to the first electrical connector;

a second section having the other one of the projection and the projection opening; and a biasing element connected between the first and second sections, the biasing element is spaced a first distance away from and is not adjacent to the other one of the projection and the projection opening on the plate.

14. The method as set forth in claim 13 wherein the second section has a neutral position where the projection is seated in the projection opening and a release position where the projection is withdrawn from the projection opening to unlock the second electrical connector from the first electrical connector.

15. A method for securing electrical connectors, the method comprising:

coupling a first electrical connector which is connected to a plate to a second electrical connector;

aligning at least one projection on one of the second electrical connector and a plate with a projection opening in the other one of the second electrical connector and the plate; and locking the second electrical connector to the first electrical connector with the engagement of the projection with the projection opening, wherein an outer periphery of the projection is substantially the same size as an inner periphery of the projection opening.

16. The method as set forth in claim 15 further comprising pivoting the plate from a neutral position where the projection is seated in the projection opening to a release position where the projection is withdrawn from the projection opening to unlock the second electrical connector from the first electrical connector.

17. The method as set forth in claim 15 wherein the outer periphery of the projection and the inner periphery of the projection opening have the substantially the same shape.

18. The method as set forth in claim 15 wherein the plate comprises:

a first section connected to the first electrical connector;

a second section having the other one of the projection and the projection opening; and a biasing element connected between the first and second sections, the biasing element is spaced a first distance away from and is not adjacent to the other one of the projection and the projection opening on the plate.

19. The method as set forth in claim 18 wherein the second section has a neutral position where the projection is seated in the projection opening and a release position where the projection is withdrawn from the projection opening to unlock the second electrical connector from the first electrical connector.

* * * * *